United States Patent [19]

Smith

[11] 4,394,042

[45] Jul. 19, 1983

[54] ICE SKATE CARRIER

[76] Inventor: David H. Smith, 454 Barkentine La., Redwood City, Calif. 94065

[21] Appl. No.: 369,560

[22] Filed: Apr. 19, 1982

[51] Int. Cl.[3] ..... B65D 71/00

[52] U.S. Cl. ..... 294/163; 206/315 R; 206/278; 224/917; 12/120.5

[58] Field of Search ..... 206/216, 278, 294, 315 R; 190/41 R, 42, 52; 224/917; 248/448, 449; 269/208, 211, 254 CS; 294/147, 148, 154, 157, 158, 159, 162, 163, 165, 168, 146; 12/120.5; 51/228; 272/70; D3/36; 280/809, 811

[56] References Cited

U.S. PATENT DOCUMENTS

| | | | |
|---|---|---|---|
| D. 260,575 | 9/1981 | Brown, Jr. | D3/36 |
| 2,566,656 | 9/1951 | David | 269/254 CS |
| 3,013,286 | 12/1961 | Barreca | 294/162 |
| 3,209,870 | 10/1965 | Johns | D3/36 |
| 3,248,027 | 4/1966 | Pfleider | 294/162 |
| 3,297,219 | 1/1967 | Selnes | 12/120.5 |
| 3,348,665 | 10/1967 | Andretich | 206/315 R |
| 3,584,351 | 6/1971 | Sliwinski | 269/254 CS |
| 3,777,956 | 12/1973 | Jung | D3/36 |
| 4,021,054 | 5/1977 | Csutor | 206/216 |
| 4,126,256 | 11/1978 | McGruder | 190/41 R |
| 4,131,196 | 12/1978 | Csutor | 206/278 |

FOREIGN PATENT DOCUMENTS

| | | | |
|---|---|---|---|
| 944156 | 3/1974 | Canada | 51/228 |
| 356219 | 7/1922 | Fed. Rep. of Germany | 269/211 |

*Primary Examiner*—Joseph Man-Fu Moy
*Assistant Examiner*—David T. Fidei
*Attorney, Agent, or Firm*—T. R. Zegree

[57] ABSTRACT

A portable, rigid carrier for ice skates comprises an upright wall having two lateral panels and narrow front and rear sides, each side being provided with a central longitudinal slit adapted for insertion of an ice skate blade. An ice skate fastened to a shoe is held in a fixed position in the carrier by means of a spring-loaded locking means cooperating with an adjustment means, both means being located between the two lateral panels. There is also described a carrier comprising a pair of spaced upright walls joined by transverse spacers and provided with registering apertures in the walls. A bag disposed between said walls is included for convenient storage and removal of articles needed by a skater.

11 Claims, 7 Drawing Figures

ICE SKATE CARRIER

BACKGROUND OF THE INVENTION

The present invention relates to an improved carrier specifically adapted for ice skates. More particularly, the invention relates to a novel portable rack-type carrier adapted for use by skaters for transportation and storage of one or two pairs of ice skates.

Certain types of carrying devices for ice skates have been described in the patent literature. For example, U.S. Pat. No. 4,021,054 and U.S. Pat. No. 4,131,196, both to Csutor, disclose a box-like carrying case for ice skates and related accessories. U.S. Pat. No. 4,126,256 to McGruder teaches a carrier case for roller skates or ice skates having two connected compartments shaped to the form of the article enclosed therein. U.S. Pat. No. Des. 252,595 to Rogers illustrates a carrier for a pair of ice skates comprising a pair of vertical slats joined by cross members and a retaining element attached to each slat.

While the above-mentioned prior art patents describe various concepts of ice skate carriers, the device of this invention provides a new approach to the structure of such carriers as it includes certain distinct features not heretofore known in the art.

OBJECTS OF THE INVENTION

Accordingly, it is the main object of this invention to provide a new and improved portable ice skate carrier which is adapted for convenient and safe transportation of one or two pairs of ice skates by a user.

Another object of the present invention is to provide a carrier for ice skates in which the skate blades are held secured by especially designed mechanism built within the carrier.

A further object of this invention is to provide a sturdy carrier into which ice skates may be quickly inserted as well readily removed therefrom.

A further object of the invention is the provision of a double-walled ice skate carrier of an open-type construction which may be combined with a bag attached thereto and adapted for transportation and storage of accessories associated with skating activities.

A still further object of this invention is to provide a carrier for ice skates affixed to shoes which can be easily manufactured from readily available materials and can achieve wide commercial acceptance.

These and other objects of the invention will become more fully apparent from the following description taken in conjunction with the accompanying drawing.

BRIEF SUMMARY OF THE INVENTION

In accordance with this invention, there is provided a portable, rigid carrier for a pair of ice skates. The carrier includes an upright wall having a narrow front side, a narrow rear side, a pair of lateral panels having planar surfaces, a top and a bottom. A central longitudinal slit is provided in the front and rear sides of the wall and extends from the lower portion to the upper portion of said sides. Each of the lower portions of said sides is provided with an adjustment means located in the slit and comprising a plurality of pairs of opposite notches and a peg member removably insertable therebetween. A spring-loaded locking means is positioned between said panels in each of the upper portions of the front and rear sides of the carrier. The adjustment means and the locking means cooperate with each other to allow a skate blade to be accomodated in the slit and held in a fixed position when inserted therebetween into the slit with edges of the blades disposed in the interior of the carrier thereby protecting them from possible damage during their transportation or storage.

In the alternate embodiment of this invention, a carrier is adapted for accomodation of two pairs of ice skates, each pair of skates being inserted in slits provided in the front and rear side of each wall, as described hereinabove. A carrier according to this embodiment comprises two spaced apart, opposed upright walls disposed in parallel relationship. The two walls have substantially the same configuration and dimensions and are connected to each other by a plurality of transverse spacers. In the preferred embodiment, the two upright walls are of substantially triangular shape and provided with an aperture in the central portion thereof, the perimeter around said aperture being of a similar configuration to the outer perimeter of each wall. The two apertures are arranged in a mutually aligned relationship. Such carrier further comprises a bag disposed between the two upright walls and supported by transverse spacers for convenient storage and transportation of any articles needed by the user of the carrier.

BRIEF DESCRIPTION OF THE DRAWINGS

The invention will now be more fully described with reference to the accompanying drawings, wherein.

DETAILED DESCRIPTION

Figure 1:
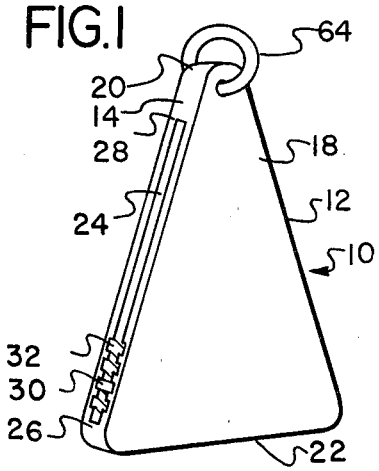
FIG. 1 is a perspective view of the carrier having a single wall.

As illustrated in FIG. 1, by way of an example, an upright ice skate carrier 10 of substantially triangular configuration comprises a single upright wall 12 having front side 14, opposite rear side (not shown), a pair of lateral panels, the front panel being designated 18 (the opposite rear panel not shown), a rounded angular top 20 and a flat base or bottom 22, the front and rear sides 14 and 16, the top 20 and the bottom 22 all being relatively narrow of the same width in the range of $\frac{5}{8}$ in. to 1 in. (1.6 cm. to 2.5 cm.), preferably about $\frac{3}{4}$ in. (1.9 cm.). The base or bottom 22 is from about 8 in. to 14 in. (20.3 cm. to 35.6 cm.) long, preferably about 10 in. (25.4 cm.). The front and rear sides 14, 16 extend symmetrically downwardly from top 20 to bottom 22 and each side is provided with a longitudinal slit 24 about 1.5 in. deep (3.8 cm.) and about 10 in. (25.4 cm.) long extending from the lower portion 26 of each side 14 and 16 to the upper portion 28 thereof. The slit 24 is of a width sufficient for an easy insertion of a standard ice skate blade therein, its width of about ⅜ in. (1 cm.) being generaly satisfactory. A handle 64 is fixedly attached by any suitable means adjacent top 20 of carrier 10 to facilitate carrying thereof by hand. Formed in the lower portion of slit 24 is adjustment means 30, which will be described hereinafter, comprising a plurality of inwardly and downwardly inclined notches 32.

Figure 2:
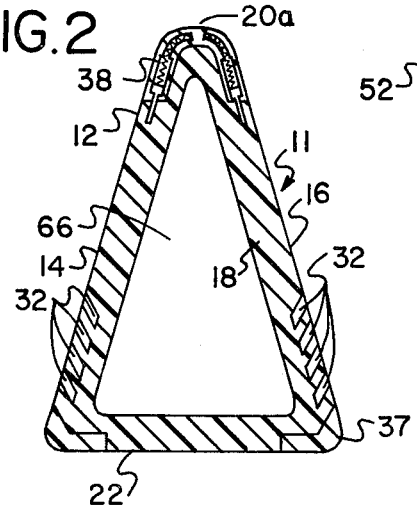
FIG. 2 is a sectional side elevational view of a similar carrier having a central aperture therein, showing a spring-loaded locking means in the upper portion thereof and notches forming a part of the adjustment means in the lower portion thereof.

Carrier 11 shown in FIG. 2 is of the same size as carrier 10, except that it is of a generally trapezoidal configuration having a substantially flat top 20*a* between front side 14 and rear side 16 and is provided with an unobstructed aperture 66 through central portion of panels 18, the perimeter around said aperture being of substantially similar configuration to the outer perimeter of carrier 11. The width of top 20*a* is preferably adapted so that a hand may be inserted thereunder for convenient carrying of the carrier without necessitating a separate handle. A spring-loaded locking means 38 is disposed in the upper portions of front and rear sides 14, 16 between lateral panels 18. Four notches 32 extend downwardly in the lower portion of front and rear sides 14, 16 at an acute angle of about 30°–45° in relation to horizontal plane for a short distance somewhat greater than a half of the width of each panel 18. Two curved insert elements 37, the outer perimeter of which is the same as that of the adjacent lower portions of carrier 11 are disposed along the opposite corners of the carrier between panels 18. The thickness of insert elements 37 is the same as that of housing 40 so that panels 18, when joined together, are spaced uniformly throughout the entire body of the carrier and form a slit 24 in front and rear sides 14 and 16, extending from the upper edge of insert element 37 to the lower edge of housing 40 and another slit (not shown) in bottom 22 extending laterally between the two corners of the carrier. It will be noted that the width of top 20*a* may be extended to correspond to the width of bottom 22, thereby forming a carrier having an upright wall 12 of substantially rectangular configuration.

Figure 3:
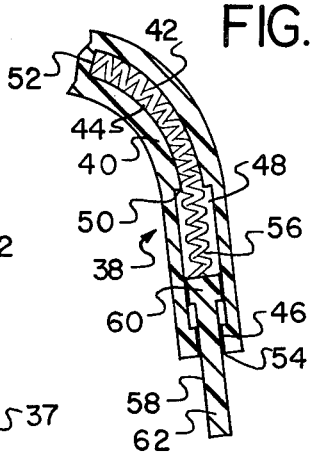
FIG. 3 is an enlarged, fragmentary side view of the carrier showing the details of spring-loaded locking means in its relaxed position.

FIG. 3 shows the details of spring-loaded locking means 38 positioned within each side 14 and 16 between panels 18 in housing 40, the outer perimeter of housing 40 being substantially parallel to the contour of the adjacent upper portions of panels 18 as to be flush therewith. Housing 40 is provided with two centrally disposed channels 42 on each side thereof, each channel having an upper section 44, a relatively short lower section 46 and a central section 48, the latter having a somewhat greater width formed by shallow recesses 50. Each upper section 44 has a closed end 52, whereas each lower section 46 has an open end 54 which forms a passage from channel 42 into the area of slit 24. Locking means 38 further includes two coil springs 56, each spring being located in the upper and central sections 44 and 48 of each channel 42, respectively. Springs 56 extend in their relaxed or compressed position between each closed end 52 and the top surface of a longitudinal, T-shaped compressing member 58 having a head 60 positioned in recess 50 of central section 48 and leg 62 being sized and adapted for a slidable snug fit with the inner walls of lower section 46 of channel 42 projecting partially outwardly through open end 54 thereof into the area of slit 24 situated thereunder. When compressing member 58 is pushed upwardly, spring 56 is in compressed position, the lower end thereof resting on top of head 60 of compressing member 58, the upper end thereof connecting with closed end 52 of channel 42, thereby producing a locking engagement for a skate blade held between compressing member 58 and adjustment means 30.

Figure 4:
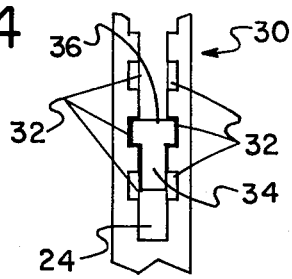
FIG. 4 is an enlarged, fragmentary front view of the carrier showing the details of the adjustment means.
Figure 5:
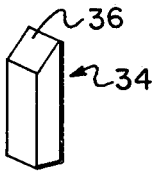
FIG. 5 is an enlarged perspective view of a peg member.

The adjustment means 30 is illustrated in more detail in FIG. 4 wherein notches 32 extend angularly downwardly and inwardly in the lower portion of slit 24 from the edge of each of the panels 18 and are substantially equally spaced from each other. Notches 32 are of the same dimensions to enable a slidable insertion of peg member 34 in each of them and its removal therefrom if another adjustment is desired. The elongated peg member 34 shown in FIG. 5 is constructed and sized to fill the rectangular space between each pair of complementary notches 32 and is formed so that its sloping top wall 36 provides a continuous, flat surface together with the adjacent surface of front and rear sides 14 and 16 when peg member 34 is engaged in a selected notch 32.

Figure 6:
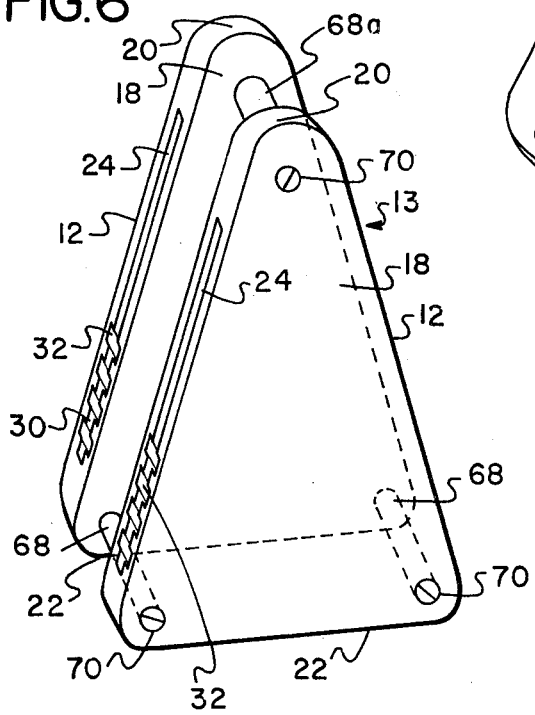
FIG. 6 is a perspective view of an alternate structure of the carrier having a pair of spaced upright walls.

An alternate embodiment of the present invention is illustrated in FIG. 6, wherein a double-walled, self-standing carrier 13 is adapted for accomodation of two pairs of ice skates frequently used by advanced skaters. A carrier of this type comprises two spaced apart, opposed upright walls of similar shape to the single wall of carrier 10, the walls being disposed in a parallel relationship, each having generally the same configuration and dimensions and connected to each other by a plurality or rigid, transverse spacers 68 of substantially the same length. Transverse spacers 68, which may be of cylindrical, rectangular or triangular shape are secured to both walls 12 by appropriate means, such as screws 70 or the like, or by insertion of their ends into openings (not shown) especially provided in the inner surface of walls 12. Generally, three spacers 68 are sufficient to produce a structurally rigid carrier having a stable equilibrium when placed on a flat, horizontal surface with or without ice skates inserted therein. It will be noted that the uppermost spacer 68*a* can be used advantageously as a carrying handle for the carrier.

Figure 7:
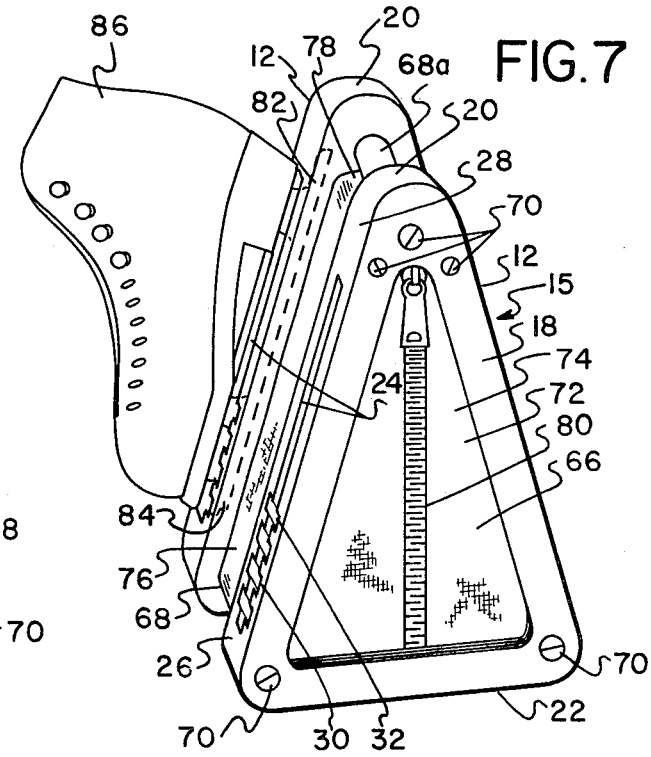
FIG. 7 is a perspective view of a carrier similar to that shown in FIG. 6 having a central aperture in each wall, a bag disposed between the walls and a skate inserted in one of the slits.

As shown in FIG. 7, a carrier 15 having a similar contour and size as the carrier shown in FIG. 6 comprises two apertures 66 in registry and a bag 72 confined within the boundaries of the carrier's structure between the upright walls 12. Bag 72 of closed type construction includes a front wall 74, an opposite rear wall (not shown), a pair of inclined side walls 76, a top wall 78 and a bottom wall (not shown). Bag 72 is made of a suitable, preferably waterproof or water-repellent, flexible, relatively heavy fabric or plastic material and is disposed on and supported by four transverse spacers 68 positioned between upright walls 12 in substantial parallelism to each other to rigidly fasten walls 12 together. In this way, the outer perimeter of side walls 76 is generally the same as that of walls 12. Another transverse spacer 68*a* secured to walls 12 above top wall 78 of bag 72 and positioned in parallel relation to the other spacers 68 is provided to function primarily as a convenient carrying handle for carrier 15.

The front wall 74 of bag 72 is equipped with a vertically and centrally disposed zipper device 80 for opening and closing the bag. Zipper 80 extends from the upper portion to the lower portion of bag 72 for easy insertion or removal of various articles or accessories needed by skaters. A small size, separate pocket (not shown) may be included in the structure of bag 72 in the lower portion of the opposite rear wall. Such pocket is formed with a transversely disposed zipper device (not shown) for easy access to the interior thereof.

An ice skate 82 having a blade 84, shown in dashed lines in FIG. 7, affixed to a sole of shoe or boot 86 is positioned in carrier 15 or in the other types of carriers described hereinabove by slidably inserting the rear end of the skate into slit 24 and applying sufficient force in the upper direction against leg 62 of compressing member 58 to move it upwardly while compressing spring 56. The front end of skate 82 will rest on peg member 34 positioned firmly in one of the notches 32 suitably selected for the length of the skate. In this manner, the skate is forced into locking engagement in any type of carrier described herein to prevent accidental displacement thereof while the carrier is being carried. To remove a skate from the carrier, the rear end of the skate is again pushed upwardly to release its front end from the locking engagement with the carrier, then downwardly to depress the spring and detach the rear portion of blade 84 from compressing member 58. In this manner, the skate is easily and quickly removed from the carrier.

The carrier of this invention may be manufactured from any appropriate material, such as plastic, wood, light metal and the like. When a plastic material is employed, any of the well known molding methods, such as injection molding, may be used. The plastic material should be characterized by high impact resistance and non-brittleness especially at a low temperature. Upright wall 12 may be conveniently assembled by securing adhesively housing 40 of locking means 38 and two insert elements 37 to the inner surface of one side of wall 12 in the respective locations described hereinabove and thereafter securing adhesively the other inner surface of wall 12 to the exposed side of housing 40 and insert elements 37.

It will be apparent from the foregoing description that I have devised a novel portable and adjustable sturdy carrier for ice skates which is useful to skaters, particularly to advanced skaters, who can carry their skates conveniently in an improved manner. The skate carrier is characterized by a combination of new features which are advantageous for their basic functions. In all forms of the present invention, the ice skate blades are maintained firmly in a fixed position when inserted in the interior of the slits described herein so that the blade edges are hidden and consequently protected from possible damage during transportation of skates due to inadvertent contact with a foreign object.

It will be understood that various modifications in the form or in the constructional details of the invention as herein described may be made without departing from the spirit thereof or the scope of the claims which follow.

I claim:

1. In a portable, rigid carrier for a pair of ice skates including: an upright wall having a front side, a rear side, a pair of lateral panels having planar surfaces, a top and a bottom, the improvement comprising:

a central, longitudinal slit extending from lower portion to upper portion of said front and rear sides;

each of said lower portions provided with an adjustment means located in said slit comprising a plurality of pairs of opposite notches and a peg member removably insertable therebetween;

each of said upper portions of said front and rear sides provided with a spring-loaded locking means positioned between said panels;

said adjustment means and said locking means cooperating with each other for holding an ice skate blade in a fixed position in said carrier when said blade is inserted therebetween in said slit.

2. The carrier of claim 1, wherein a carring handle means is fixedly attached adjacent the top thereof.

3. The carrier of claim 1, wherein an aperture is provided through central portion of each of said panels.

4. The carrier of claim 1 adapted for accomodation of two pairs of skates comprising:

two spaced apart, opposed upright walls disposed in parallel relationship having substantially the same configuration and dimensions; and a plurality of transverse spacers connecting said walls to each other.

5. The carrier of claim 4, wherein said upright walls are of substantially triangular shape and provided with an aperture in the central portion thereof, the perimeter around said aperture being of a similar configuration to the outer perimeter of said walls, said apertures being arranged in a mutually aligned relationship.

6. The carrier of claim 5, wherein said notches are substantially equally spaced from each other and extend angularly downwardly from the edge of each of said panels.

7. The carrier of claim 5, wherein said peg member is constructed to fill the space between each pair of said notches.

8. The carrier of claim 5, wherein said locking means is positioned in a housing having its outer and inner perimeter substantially parallel to the contour of adjacent portions of said panels, said housing being provided with two centrally disposed channels, each channel having an upper section, a lower section and a central section having a recess, a closed end in the upper section and an open end in the lower section.

9. The carrier of claim 8, wherein said locking means comprises:

a pair of coil springs located in the upper and central sections of each of said channels; and a longitudinal, T-shaped compressing member having a head and a leg, said member being adapted for a slidable engagement with said spring;

said head disposed in the recess of said central section and said leg projecting partially outwardly through the open end of said lower section.

10. The carrier of claim 5 further comprising a bag including a front wall, a rear wall, two side walls, a top wall and a bottom wall, said bag being disposed between said upright walls and supported by said transverse spacers, the front wall of said bag having a vertically and centrally arranged zipper device for opening and closing the bag.

11. The carrier of claim 10 further comprising a pocket disposed in said rear wall of the bag and provided with a transverse zipper device.

* * * * *